United States Patent [19]

Yang

[11] Patent Number: 4,569,214

[45] Date of Patent: Feb. 11, 1986

[54] PUSH BUTTON SECURITY LOCK

[76] Inventor: Yaw-Kuen Yang, No. 190-30, Chang Shui Rd., Chang Hua City, Taiwan

[21] Appl. No.: 532,276

[22] Filed: Sep. 14, 1983

[51] Int. Cl.[4] ..... E05B 37/16

[52] U.S. Cl. ..... 70/298; 70/3; 70/76; 70/315

[58] Field of Search ..... 70/2-5, 70/67-76, 287, 297-299, 315

[56] References Cited

U.S. PATENT DOCUMENTS

| | | | |
|---|---|---|---|
| 3,236,078 | 2/1966 | Eckardt et al. | 70/287 |
| 3,436,938 | 4/1969 | Walters | 70/298 X |
| 3,514,981 | 6/1970 | Esquibel et al. | 70/298 |
| 3,910,078 | 10/1975 | Schulz | 70/287 X |
| 4,176,533 | 12/1979 | Nordendale | 70/298 X |

*Primary Examiner*—Gary L. Smith
*Assistant Examiner*—Russell W. Illich
*Attorney, Agent, or Firm*—Ladas & Parry

[57] ABSTRACT

A push button security lock for baggage comprises two casings respectively mounted on the upper and lower portions of the baggage, the first casing housing a plurality of latch members each of which has a first and a second loop members and can be turned to set at a first position in which the first loop member is projected downward or at a second position in which the second loop member is projected downward, the second casing housing a plurality of clasp members each of which has a first hook member and a second hook member for respectively catching the first and second hook members when the baggage is closed. The lock can be opened when the clasp member is depressed in a proper combination corresponding the combination of the latch members which are selectively set at the first positions.

9 Claims, 6 Drawing Figures

PUSH BUTTON SECURITY LOCK

BACKGROUND OF THE INVENTION

This invention relates to a security lock, particularly to a lock that can be opened by depressing keys in a proper combination.

It is known to provide security locks operated by dialling wheels that can be turned to a series of numerals in a proper combination or by depressing button keys in a proper key combination so that one need not use a losable key. Those which are operated by button keys are usually electronic type which must be incorporated with a complex mechanism that may cause inconvenience and unreliablity to the user.

SUMMARY OF THE INVENTION

An object of the invention is to provide a push button security lock of reliable and simplified construction.

According to the invention a security lock is provided which comprises, a first and a second casings respectively mounted on the upper and lower portion of the baggage. The first casing houses a plurality of latch members which is mounted on a shaft for limited rotation and each of which has a first and second loop members angularly spaced apart. Each latch member can be set at a first position in which the first loop member is directed downward or at a second position in which the second loop member is directed downward. The second casing houses a plurality of clasp members for respectively catching the latch members, each of clasp members having a first and second hook members for respectively engaging with the first and second loop members. There is further provided a locking means for moving the clasp members in a first direction so as to place the lock in its closed position in which the first hook members and first loop members are engaged respectively. Each of the clasp members further has a key formation and upon depression the key formation the clasp member is moved to a second direction opposite to the first direction so that the first loop member is disengaged from the first hook member. The lock is opened when the clasp members are depressed in a proper combination of key formations in accordance with the combination of the latch members which are selectively set.

Advantageously, there are further provided restricting means for preventing the latch members from the rotational movement. The restricting means may includes protrusion means provided on the inner surface of the first casing corresponding to the number of the latch members. Each of the latch members has a body of quadratic prism shape having a portion cut away to form a sloping side on which is provided with a stud member which defines with the sloping side, two notches which will be engaged with the protrusion means when the latch member is set. On the shaft is further provided a spring member for urging the shaft lengthwise. The notch of the latch member can be released from the protrusion means to allow the rotation of the latch member for position change by manual operation when the shaft is moved against the biassing direction of the spring. There is further provided a plurality of spring plates for releasably restricting the latch member when the shaft is moved against the biassing direction of the spring.

The manner in which the above and related objects are accomplished together with the attending advantages and features of the invention appear more fully from the following detailed description and drawings.

DETAILED DESCRIPTION OF THE PREFERRED EMBODIMENT

Figure 1:
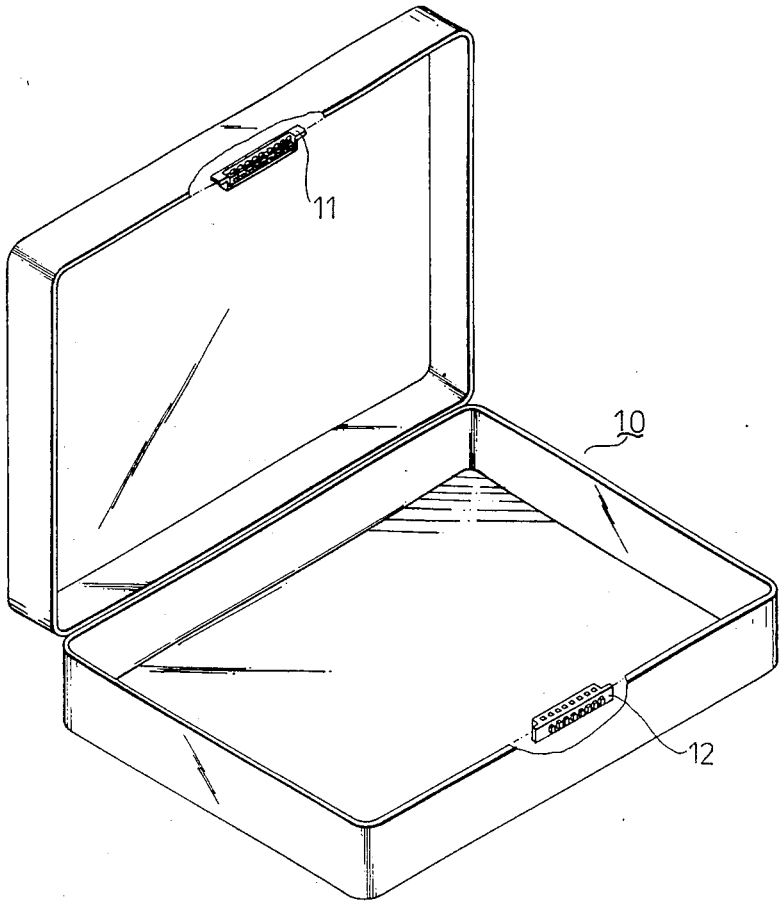
FIG. 1 is a view showing a security lock constructed according to the invention mounted on a baggage.
Figure 3:
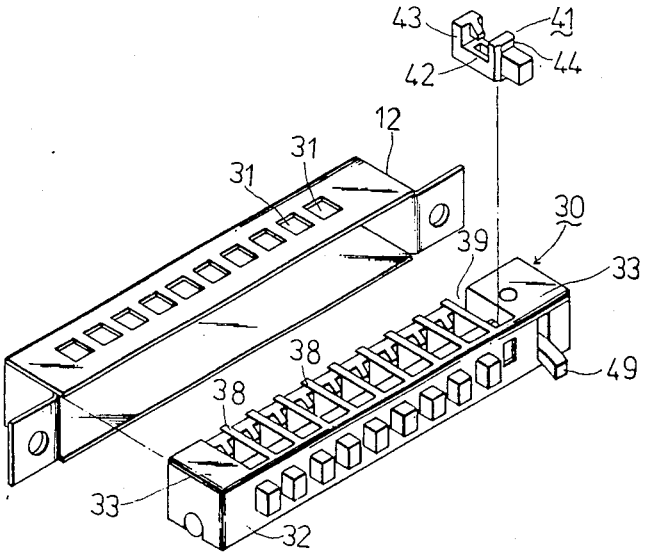
FIG. 3 is an exploded view showing the second casing and the clasp members.
Figure 2:
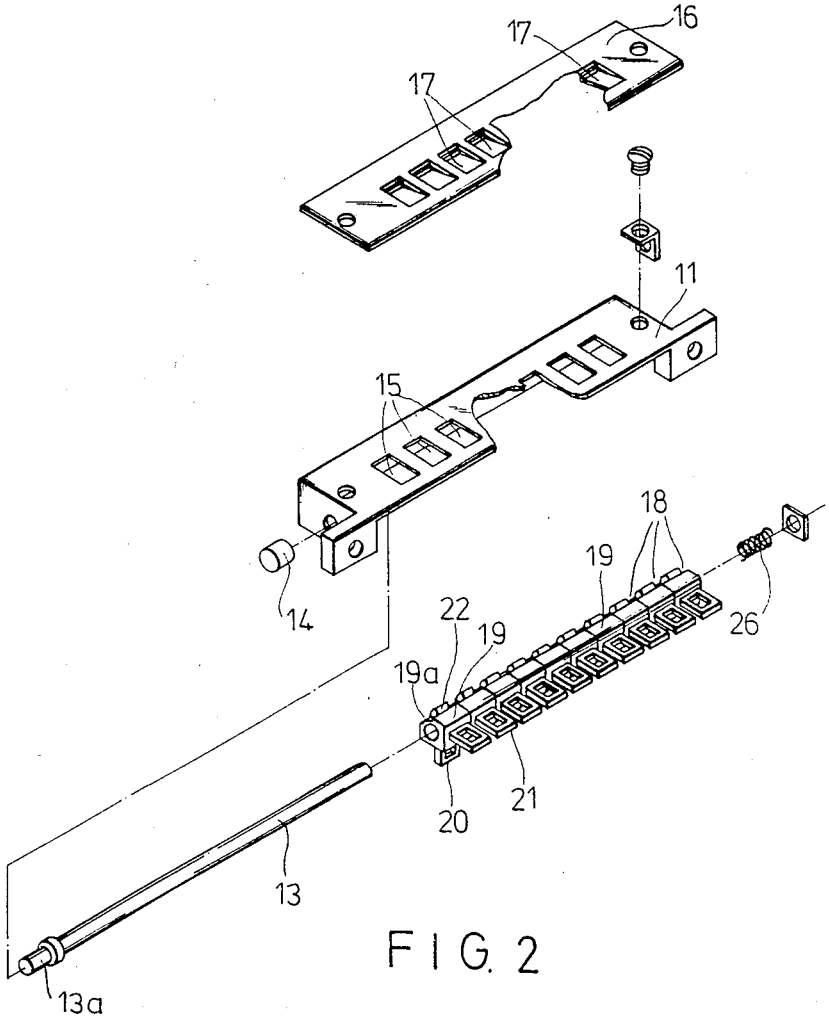
FIG. 2 is an exploded view showing the first casing and the latch members.
Figure 4:
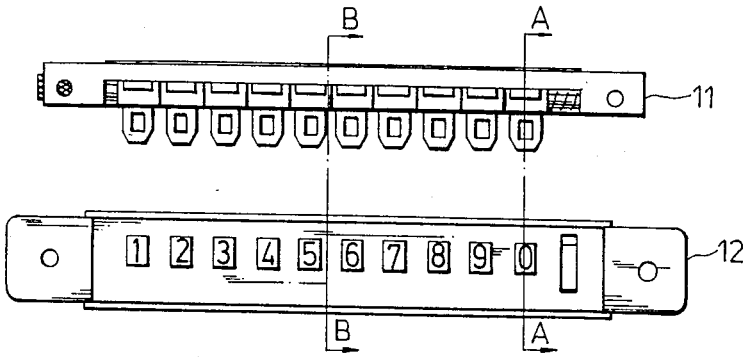
FIG. 4 illustrates the relation between the positions of the latch members and the clasp members.

Referring to FIGS. 1,2,5 and 6, there is shown a security lock which includes a first casing 11 and a second casing 12 adapted to be mounted on the upper portion and lower portion of the baggage 10 respectively. In the first casing 11 is mounted a shaft 13 which has an end portion 13*a* extended outwardly of the first casing 11 and is provided with a control knob 14. The first casing 11 further has slots 15 provided in the top wall thereof and a top plate 16 which are provided with spring members 17 respectively received in the slots 15. On the shaft 13 is rotatably mounted a plurality of latch members 18 corresponding to the number of the slots 15. Each of the latch members 18 has a body 19 of a quadratic prism shape having a portion cut away to form a sloping side 19*a*, and a first and second loop members 20 and 21 which are angularly spaced apart. On the sloping side 19*a* of each body 19 is provided a stud member 22 which defines, with the sloping side 19*a*, two notches 23 and 24 on both sides thereof.

Figure 5:
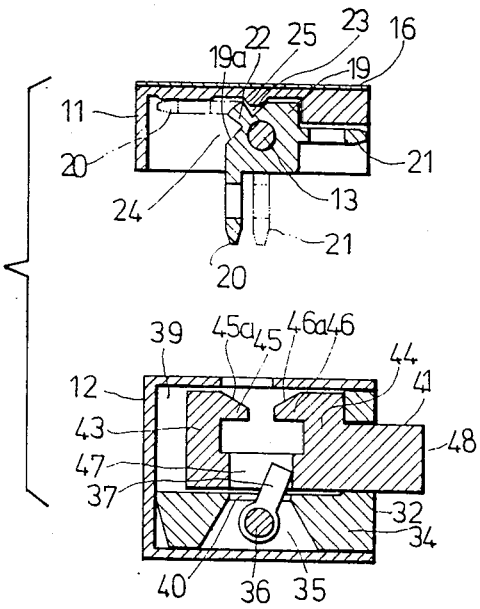
FIG. 5 is a sectioned view taken from the line A—A' of FIG. 4.
Figure 6:
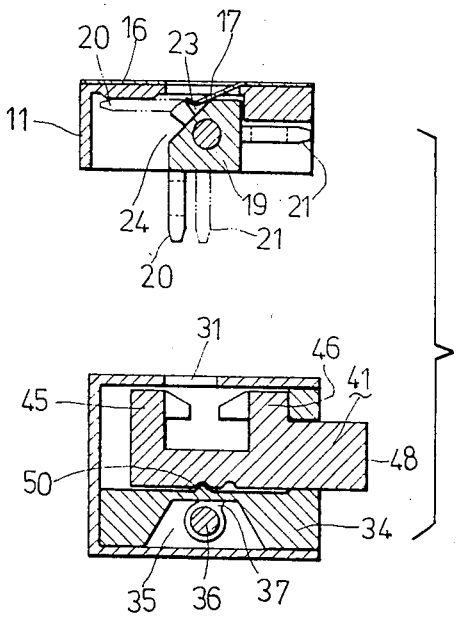
FIG. 6 is a sectioned view taken from the line B—B' of FIG. 4.

Between each two spring members 17 is provided a protrusion 25 on the inner surface of the casing 11, as better seen in FIG. 5, for restricting the rotation movement of the latch member 18. Each latch member 18 can be set at a first position in which its first loop member 20 is extended downward or at a second position in which its second loop member 21 is extended downward, the planes in which the first and second loop members 20 and 21 lie when they are extending downward being parallelly spaced apart as can be seen from FIG. 5. When the first loop member 20 is extended downward, the notch 23 will be engaged with the protrusion 25, and when the second loop member 21 is extended downward, the notch 24 will be engaged with the protrusion 25. There is further provided a spring coil 26 which is sleeved onto the shaft 13 for urging it in the direction towards the knob 13*a*. The latch member 18 can be changed from the first position to the second position or vice versa, by depressing the knob 13*a* to move the shaft 13 against the biassing direction of the spring coil 26 so that all the latch members 18 are released from the restriction of the protrusions 25.

It can be noted that the width of the studs 22 are shorter than the respective width of the bodies 19 of the latch members 18 and therefore when the knob 13*a* is depressed, the notches 23 or 24 are disengaged from the protrusions 25 respectively. At this condition, the protrusions 25 are at the positions above the sloping side 19*a* of the latch members 18, and the notches 23 or 24 come to engage with the spring members 17, as better seen in FIG. 6, When a latch member 18 is turned by hand, the stud 22 pushes the respective spring member 17 which releasably restricts its movement for positioning after it is released from the protrusion 25 and preventing the adjacent latch members 18 from movement when it is turned.

Referring to FIGS. 3, 4, 5 and 6, the casing 12 has an elongate support body 30 provided lengthwise therein, and a plurality of slots 31 provided on the top wall thereof. The support body 30 is constituted of a front wall 32, two side blocks 33 and a base 34 surrounded by the front wall 32, and side blocks 33. The base 34 includes a channel 35 which extends lengthwise and in which is mounted a shaft 36 having spaced apart pins 37 mounted thereon. On the base 34 are provided spaced apart partition plates 38 for confining rooms 39 which are in communication with the channel 35 through openings 40 and respectively receive clasp members 41.

Each of the clasp members 41 is in a U-shape having a transverse member 42 and two upstanding limbs 43 and 44 which are respectively provided with first and second hook ends 45 and 46, the first and second hook ends 45 and 46 extending inwardly and oppositely. Each transverse member 42 is provided with a hole 47 in registration with the opening 40 of the base 34. There is further provided a key formation 48 on the upstanding limbs 44 of each clasp member 41 and extending outwardly of the front wall 32.

It can be seen that the pins 37 are extending upward through the opening 40 of the base 34 and then into the holes 47 of the clasp members 41 respectively. The shaft 36 is further provided with a lever 49 which, upon being pressed downward, actuates the pins 37 to move all clasp members 41 outwardly so that the key formations 48 of all clasp members 41 are in their protruded positions.

In operation, one must select a combination of the latch members 18 and set them in their first positions in which the first loop members 20 thereof projected downward as shown in FIG. 5. At this condition, other latch members 18 are at their second positions in which the second loop members 21 are projected downward. When the baggage 10 is closed, if the clasp members 41 are at their outward position, the downwardly projecting first loop members 20 slide along the sloping surface 45*a* of the respective hook ends 45 and get into between the hook ends 45 and 46 respectively by moving the respective clasp members 41 inward whereas the downwardly projecting second loop members 21 directly get into between the hook ends 45 and 46 of the respective clasp members 41. If the clasp members 41 are at their inward position, the downwardly projecting first loop members 20 directly get into between the hook ends 45 and 46 of the respective clasp members 41 whereas the downwardly projecting second loop members 21 slide along the sloping sides 46*a* of the respective hook ends 46 and get into between the hook ends 45 and 46 by moving the respective clasp members 41 outward.

Thereafter, the lock is placed in its closed position by depressing down the lever 49 so that all clasp members 41 are moved outward. As the clasp members 41 are moved outward, the first hook ends 45 of the clasp members 41 come to engage with the first loop members 20 of the latch members 18 which are selected. It can be appreciated from FIG. 6 that the base 34 of the support body 30 is further provided with retractable projections 50 which can be constructed by a known manner, such as by providing spring biassed balls in cavities, on both sides of each opening 40 for releasably holding each clasp member 41 when it is moved outward. When the clasp members 41 are depressed in a proper combination of the key formations corresponding to the combination of the latch members 18 selected, all the downwardly projected loop members 20 are released from the catch of the hook ends 45, thereby placing the lock in its opened position.

It can be appreciated that, if someone depresses a wrong key formation 48, the lock can not be opened as the second loop member 21 of the latch member 18 is caught by the second hook end 46 of the clasp member 41.

With the invention thus explained, it is apparent that obvious modifications and variations can be made without departing from the scope of the invention. It is therefore intended that the invention be limited only as indicated in the appended claims.

I claim:

1. A push button security lock for baggage comprising:

a first casing adapted to be mounted on the upper portion of the baggage;

a shaft mounted in said first casing;

a plurality of latch members each of which has a first and a second loop member, and mounted on said first shaft for limited rotation so that they can be turned to a first position in which said first loop member is projected downward or to a second position in which said second loop member is projected downward;

means for restricting said latch members from rotation after they are turned to said first or second position;

means for releasing said latch members from said restricting means;

a second casing adapted to be mounted on the lower portion of the baggage;

a plurality of clasp members each of which has a first and a second hook (members) member for respectively catching said first and second loop members when they are projected downward and (has) each of said clasp members further having, a key formation, said clasp members being movably mounted in said second casing;

means for moving all clasp members in a first direction for placing the lock in a closed position;

wherein said first loop members are engaged with said first hook members when said clasp members are moved in said direction, said second loop members are engaged with said second hook members when said clasp members are moved in a second direction opposite to said first direction, and the lock is opened when said clasp members are depressed in a proper combination corresponding to the combination of said latch members which are selectively set at said first position.

2. A push button security lock for baggage comprising:

a first casing adapted to be mounted on the upper portion of the baggage;

a first shaft mounted in said first casing and normally biassed in a first direction;

a plurality of latch members each of which has a first and a second loop members and mounted for rotation on said first shaft so that it can be turned to a first position position in which said first loop member is projected downward or to a second position in which said second loop member is projected downward;

means for restricting said latch members from the rotation movement after they are turned to said first or second position, said restricting means capable of releasing said latch members when moving said first shaft in a second direction opposite to said first direction;

a second casing adapted to be mounted on the lower portion of the baggage;

a plurality of clasp members each of which has a first and a second hook members for respectively catching said first and second loop members and each of said clasp members further having a key formation, said clasp members being movably mounted in said second casing;

means for moving all said clasp members in a third direction so as to place the lock in its closed position; wherein said first loop members are engaged with said first hook members when said clasp members are moved in said third direction, said second loop members are engaged with second hook members when said clasp members are moved in a fourth direction opposite to said third direction upon depression of said key formation, and the lock is opened when said clasp members are depressed in a proper combination corresponding to the combination of said latch members which are set at said first position.

3. A push button security lock as claimed in claim 2, wherein said restricting means includes protrusion members provided in the inner surface of said first casing for engaging with said latch members respectively.

4. A push button security lock as claimed in claim 3, wherein each of said latch members has a first notch for engaging with said protrusion member when it is set in said first position and has a second notch for engaging with said protrusion member when it is set in said second position.

5. A push button security lock as claimed in claim 2, wherein each of said clasp members has a U-shaped member which has two upstanding limbs provided with two hook ends respectively, said hook ends projecting opposite one another;

6. A push button security lock as claimed in claim 2, wherein said moving means includes a second shaft movably mounted in said second casing below said clasp members and having pin members mounted spacedly thereon for engaging with the lower sides of said clasp members respectively.

7. A push button security lock as claimed in claim 2, further comprising means for releasably holding said clasp members after they are moved in said third direction.

8. A push button security lock as claimed in claim 7, wherein said positioning means includes retractable projections for engaging with the lower sides of said clasp members respectively.

9. A push button security lock as claimed in claim 2, further comprising a spring plate member between each two protrusions for releasably restricting said latch member when it is released from said protrusions.

* * * * *